US011150606B2

(12) United States Patent
Loetscher et al.

(10) Patent No.: US 11,150,606 B2
(45) **Date of Patent: *Oct. 19, 2021**

(54) TIMEPIECE INCLUDING A DEVICE FOR LOCKING A VALVE OR A WINDING BUTTON

(71) Applicant: Omega SA, Biel/Bienne (CH)

(72) Inventors: Philippe Loetscher, Evilard (CH); Gregory Kissling, Macolin (CH)

(73) Assignee: Omega SA, Biel/Bienne (CH)

( * ) Notice: Subject to any disclaimer, the term of this patent is extended or adjusted under 35 U.S.C. 154(b) by 60 days.

This patent is subject to a terminal disclaimer.

(21) Appl. No.: 16/655,953

(22) Filed: Oct. 17, 2019

(65) Prior Publication Data

US 2020/0150591 A1 May 14, 2020

(30) Foreign Application Priority Data

Nov. 9, 2018 (EP) ..... 18205381

(51) Int. Cl.
*G04B 3/04* (2006.01)
*G04B 37/08* (2006.01)
*G04B 19/28* (2006.01)

(52) U.S. Cl.
CPC ..... *G04B 3/043* (2013.01); *G04B 37/08* (2013.01); *G04B 19/283* (2013.01)

(58) Field of Classification Search
CPC ..... G04B 3/043; G04B 37/08; G04B 19/283; G04B 19/286; G04B 3/048; G04B 37/106;

(Continued)

(56) References Cited

U.S. PATENT DOCUMENTS 8,408,785 B2 * 4/2013 Hiranuma ..... G04B 37/08 368/291
8,419,269 B2 * 4/2013 Hiranuma ..... G04B 37/02 368/291

(Continued)

FOREIGN PATENT DOCUMENTS

CN 1690889 A 11/2005
CN 101149591 A 3/2008

(Continued)

OTHER PUBLICATIONS

Japanese Office Action dated Oct. 27, 2020 in Japanese Patent Application No. 2019-195911 (with English translation), 5 pages.

(Continued)

*Primary Examiner* — Edwin A. Leon
(74) *Attorney, Agent, or Firm* — Oblon, McClelland, Maier & Neustadt, L.L.P.

(57) ABSTRACT

A timepiece includes a locking device capable of blocking the translation of a valve or of a control member in the position the closest to the central axis of the case. The locking device includes a blocking element capable of undergoing translational displacement along a radial axis between a locking position and an unlocking position, where the member is respectively blocked or free to move in translation, a part mounted such that it can move in rotation about the central axis of the case and intended to be set in rotation by a user, drive device linking the angular displacement of the part mounted such that it can move in rotation to the translational displacement of the blocking element between the locking and unlocking positions.

19 Claims, 3 Drawing Sheets

(58) Field of Classification Search
CPC ..... G04B 37/02; G04B 47/066; G04B 3/04; G04B 3/041; G04B 3/046; G04B 37/10; G04C 3/001
USPC ..... 368/308
See application file for complete search history.

(56) References Cited

U.S. PATENT DOCUMENTS

| | | | | |
|---|---|---|---|---|
| 8,764,284 | B2 * | 7/2014 | Briswalter | G04B 37/106 368/308 |
| 10,725,429 | B2 * | 7/2020 | Loetscher | G04B 3/045 |
| 10,838,365 | B2 * | 11/2020 | Podvin | G04B 37/103 |
| 2008/0068934 | A1 | 3/2008 | Hiranuma et al. | |
| 2010/0128575 | A1 | 5/2010 | Okuda | |
| 2010/0142333 | A1 | 6/2010 | Hiranuma et al. | |

FOREIGN PATENT DOCUMENTS

| | | | |
|---|---|---|---|
| CN | 101738921 | A | 6/2010 |
| CN | 101738922 | A | 6/2010 |
| CN | 108958001 | A | 12/2018 |
| JP | 3-17590 | U | 2/1991 |
| JP | 10-213685 | A | 8/1998 |
| JP | 2002-260487 | A | 9/2002 |

OTHER PUBLICATIONS

European Search Report dated Apr. 30, 2019 in European application 18205381.9, filed on Nov. 9, 2018 (with English Translation of Categories of Cited Documents).

Korean Office Action dated Jan. 10, 2021 in Korean Patent Application No. 10-2019-0138307 (with English translation), 8 pages.

Combined Chinese Office Action and Search Report dated Dec. 15, 2020, in Chinese Patent Application No. 201911087464.X (with English translation), 13 pages.

* cited by examiner

E-E

C-C

A-A

C-C

A-A

C-C

TIMEPIECE INCLUDING A DEVICE FOR LOCKING A VALVE OR A WINDING BUTTON

CROSS-REFERENCE TO RELATED APPLICATION

This application claims priority to European Patent Application No. 18205381.9 filed on Nov. 9, 2018, the entire disclosure of which is hereby incorporated herein by reference.

OBJECT OF THE INVENTION

The present invention relates to the field of horology. It more particularly relates to a timepiece comprising a device for locking a control member such as a winding button or more generally any member than can be actuated by a user, such as a valve.

BACKGROUND ART AND PRIOR ART

Timepieces are known to comprise a locking device used to make a control member inactive. The purpose of these devices is to prevent any accidental actuation of the control member. Numerous known documents describe such a locking device for push buttons or winding buttons, which device could possibly be transposable for release valves equipping diving watches.

For example, patent document JP 2005 337792 discloses a locking device for a winding button. The locking device includes a lug integral with the inner face of a rotating bezel. For a given angular position of the bezel, the lug is positioned in a groove made in the winding button, which blocks the translational displacement thereof. This construction has the drawback of allowing the device to become blocked if the adjustment between the groove and the lug for the given angular position is imperfect.

SUMMARY OF THE INVENTION

The purpose of the present invention is to overcome the aforementioned drawbacks by proposing a timepiece comprising a device for locking a member, which device is reliable at the same time as being easy to handle by the user and aesthetic. The member designates a control member, for example a winding button or a valve.

For this purpose, the present invention proposes a timepiece comprising a locking device provided with a blocking element capable of undergoing translational displacement along the longitudinal axis of the member between a locking position and an unlocking position. The blocking element is arranged such that it locks the valve in the closed position and the winding button in the sunken position. The translational displacement of the blocking element is controlled by a part mounted such that it can move in rotation about the central axis of the case. The movable part is intended to be set in rotation by the user. This can be a rotating ring concealed beneath the bezel and integral with a grasping zone extending outside of the perimeter delimited by an edge of the case so as to be capable of being grasped by the user. This can also be a rotating ring partially concealed beneath the bezel with a visible portion framing the bezel or this can be the bezel itself. The angular displacement of the part mounted such that it can move in rotation is linked to the translational displacement of the blocking element by drive means. Said drive means comprise a cam disposed on the movable part defining a guide surface for a follower disposed on the blocking element. The guide surface is profiled such that it moves away from the central axis of the case in order to generate the translational displacement of the blocking element outwards from the case from the locking position thereof into the unlocking position thereof.

Preferentially, the cam is formed by a recess made within the part mounted such that it can move in rotation and the follower is a finger disposed on the blocking element. Preferentially, the latter is formed by a sleeve surrounding a portion of the member disposed beneath the head of said member, the sleeve including a housing intended to receive the finger projecting towards the movable part. Moreover, the sleeve includes an inward part forming a banking for a shoulder made on said portion of the member when the blocking element is translated into the locking position thereof.

Whether in the locking position or unlocking position, the blocking element remains concealed beneath the bezel without projecting beyond the perimeter delimited by the edge of the case. The device for locking the member according to the invention is thus perfectly integrated into the design of the case, while being easy to use. Moreover, regardless of the position adopted, the finger of the blocking element remains engaged with the recess of the movable part, which guarantees the reliability of the locking device.

Other features and advantages of the present invention will be better understood upon reading the detailed description given below with reference to the following figures.

BRIEF DESCRIPTION OF THE FIGURES

In FIG. 1A, the valve is locked in the closed position. In FIGS. 2A and 3A, the valve is unlocked and is respectively in the closed and open positions.

DETAILED DESCRIPTION OF THE INVENTION

The present invention relates to a timepiece of the wristwatch type comprising a device for locking a member capable of undergoing translational displacement along the longitudinal axis thereof and rotational displacement about the same axis. This can be a screwed valve 3 as shown in FIG. 1A or a screwed winding button (not shown).

Figure 1A:
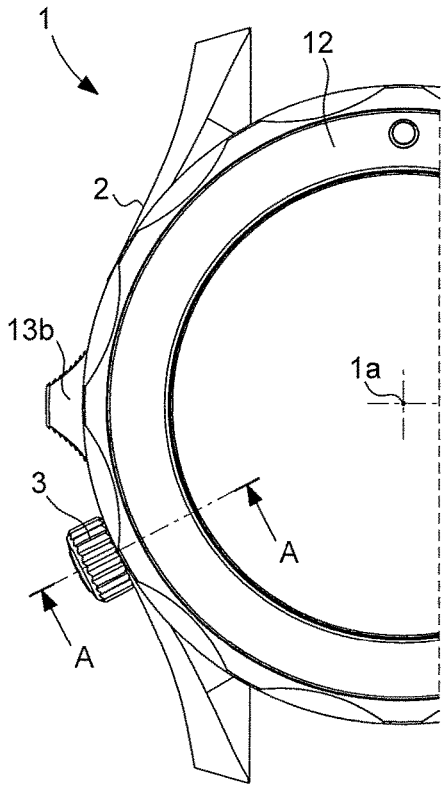
FIGS. 1A, 2A and 3A show partial plan views of the timepiece according to the invention provided with a device for locking the valve.
Figure 1B:
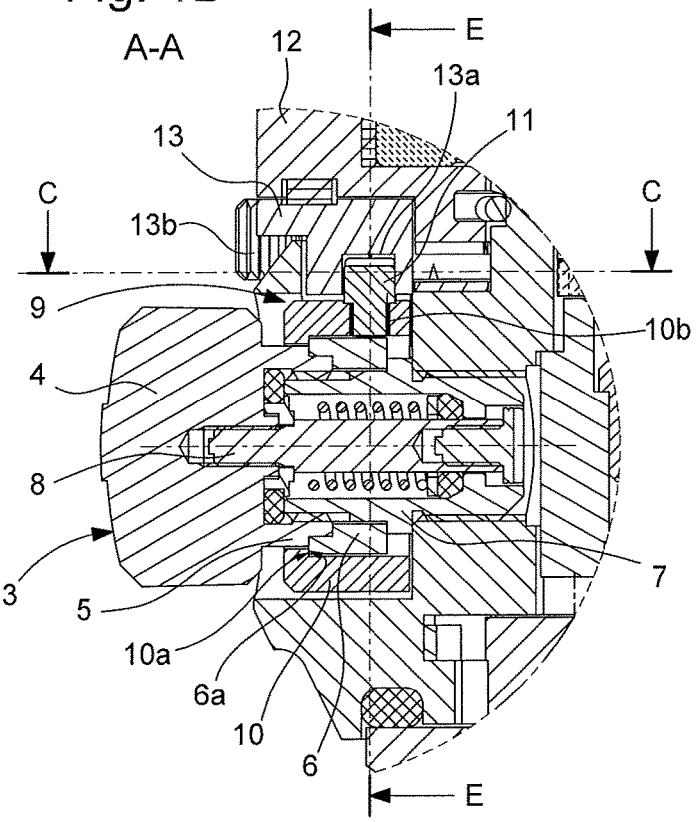
FIG. 1B shows a sectional view along the A-A axis in FIG. 1A.

With reference to FIGS. 1A and 1B, the timepiece includes, in a conventional manner, a case 1 provided with a middle part 2 and a valve 3 screwed onto a tube 7 fixed to the middle part 2. The screwing and unscrewing of the valve 3 allows the valve to be displaced in translation along the longitudinal axis thereof, which can also be referred to as a radial axis relative to the case, between a closed position and an open position which, unlike the closed position, allows a gas to be released in the event of excess pressure inside the watch case. The rod 8 integral with the valve 3 passes through the tube 7. Said valve 3 includes a head 4 which overlooks a substantially cylindrical hollow body 5 ending in a ring 6. The ring 6 has an outer diameter that is greater than that of the hollow body 5 so as to form a shoulder 6*a* at the junction between the outer faces of the hollow body 5 and of the ring 6. Preferentially, to facilitate assembly, the head 4 with the hollow body 5 is a part that is separate from the ring 6.

Figure 1C:
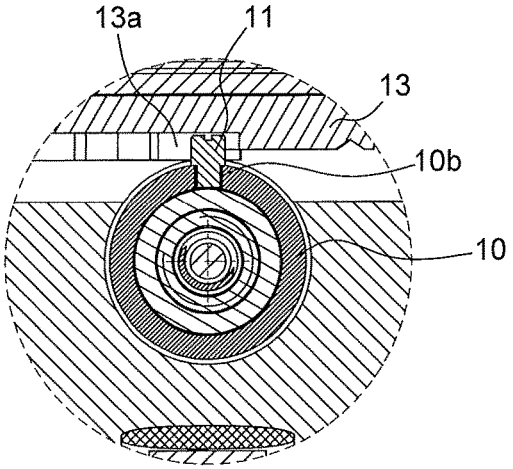
FIGS. 1C and 1D respectively show sectional views along the E-E and C-C axes in FIG. 1B.

According to the invention, the timepiece includes a locking device enabling the valve to be blocked in the closed position. The locking device includes a blocking element 9 capable of moving in translation along the longitudinal axis of the valve between a locking position and an unlocking position. The blocking element 9 surrounds the ring 6 and at least partially surrounds the hollow body 5 of the valve. It is formed by a cylindrical sleeve 10. This sleeve 10 has, on the inner face thereof, an inward part 10*a* defining a banking for the shoulder 6*a* of the ring 6 when the locking device is in the locking position thereof. In other words, the sleeve includes, on the inner face thereof, a part having an inner diameter that is less than that of the rest of the sleeve, the junction between the parts of different diameters forming the banking for the shoulder. This inward part 10*a* is disposed at the end of the sleeve 10, which is positioned facing the head 4 of the valve. The blocking element 9 further includes a finger 11 with a base housed in a recess 10*b* made in the sleeve 10 and a protruding portion projecting outside same towards the bezel 12 of the case (FIG. 1B and FIG. 1C). This finger projects in a direction parallel to the central axis 1*a* of the case 1, which is a perpendicular axis to the general plane of the case and to the longitudinal axis of the valve.

The locking device further includes a part 13 mounted such that it can move in rotation about the central axis 1*a* and intended to be set in rotation by a user. This part 13 capable of moving in rotation actuates the translational displacement of the blocking element 9 between the locking and unlocking positions. It thus has two angular positions respectively corresponding to the locking and unlocking positions. These two angular positions can, for example, be identified by a marking on the bezel. In the example shown, the movable part 13 forms a rotating ring concealed beneath the bezel 12 with a protruding portion 13*b*, which is also referred to as a grasping zone, extending outside of the perimeter delimited by an edge of the case 1 in order to allow the grasping thereof by the user. Advantageously, this grasping zone is textured to ease the handling thereof by the user. Alternatively, the movable part could also be a ring that is only partially concealed beneath the bezel, with a portion of the ring extending over the circumference of the bezel so as to be accessible to a user. According to another alternative embodiment, the movable part is the bezel itself. The movable part is kinematically linked to the blocking element via drive means.

Figure 1D:
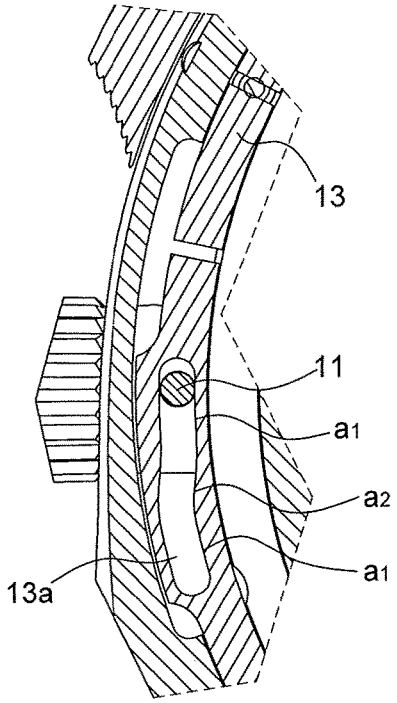

The drive means include the finger 11 of the blocking element 9 acting as a follower intended to engage with a cam disposed on the movable part 13. The cam is defined by at least one of the two side surfaces of an inner recess 13*a* made in the rotating ring 13 (FIG. 1D). The recess 13*a* includes two segments a1 respectively corresponding to the locked and unlocked positions. The segments a1 are arranged so as to move away from the central axis of the case in order to generate this axial displacement of the blocking element between the locking position which is the closest to the central axis of the case and a more remote position corresponding to the unlocking position. In the example shown in the figures, the segments a1 are rectilinear and separated by a transition zone a2 allowing the finger 11 to pass smoothly between the positions (FIG. 1D). This transition zone can be substantially rectilinear, curved or have curved and rectilinear portions. The segments and the transition zone could also form a single arc-shaped segment that is off-centred relative to the central axis of the case. The protruding portion of the finger 11 projecting outside of the blocking element can have a diameter that is substantially equal to the width of the recess 13*a* as shown in the figures. The diameter of the finger can also be smaller provided that it remains in contact with a side surface of the recess to ensure the guiding thereof. For this purpose, return means such as a helical spring can be provided to hold the finger in contact with one of the two side surfaces of the recess in both actuation directions of the movable part.

The locking device can further include means allowing the movable part to be held in the desired position without the risk of unwanted changes. For this purpose, the locking device can be provided with ball catches, where the balls are housed in cavities made in the movable part.

Figure 2A:
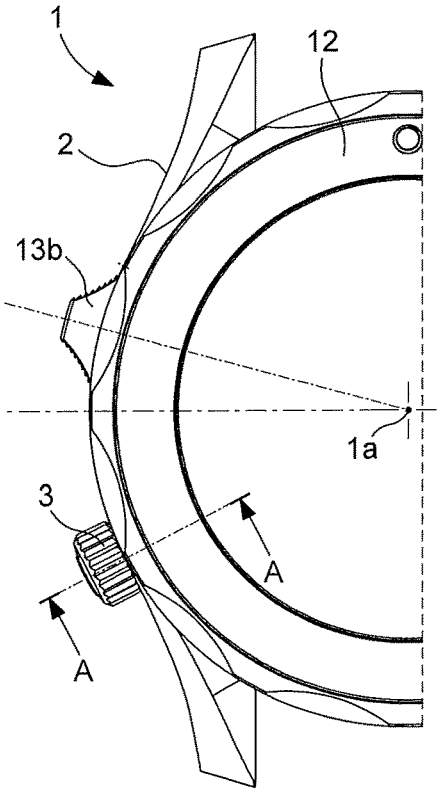
Figure 2B:
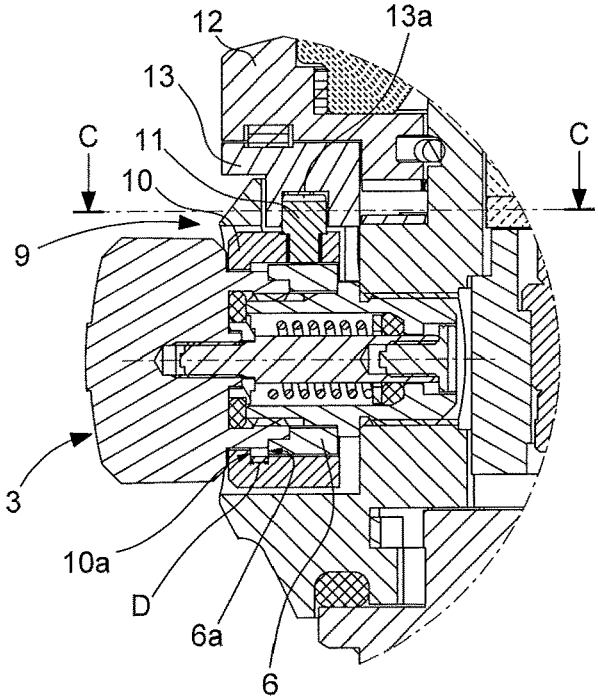
FIGS. 2B and 2C respectively show similar views to those of FIGS. 1B and 1D for the unlocked valve in the closed position and FIGS. 3B and 3C show the same views for the unlocked valve in the open position.
Figure 2C:
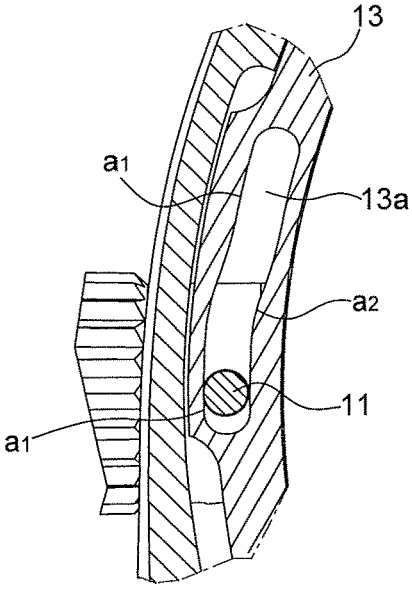
Figure 3A:
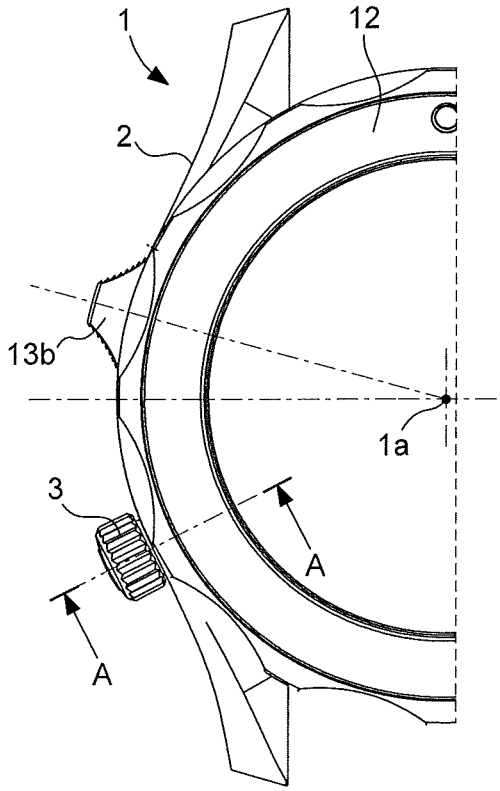
Figure 3B:
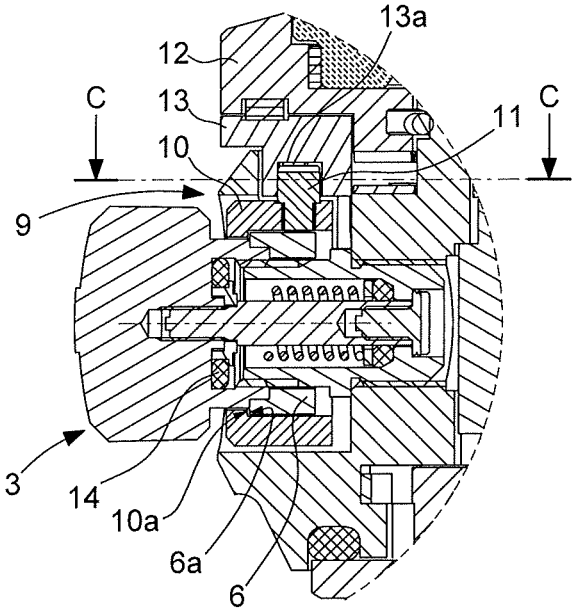
Figure 3C:
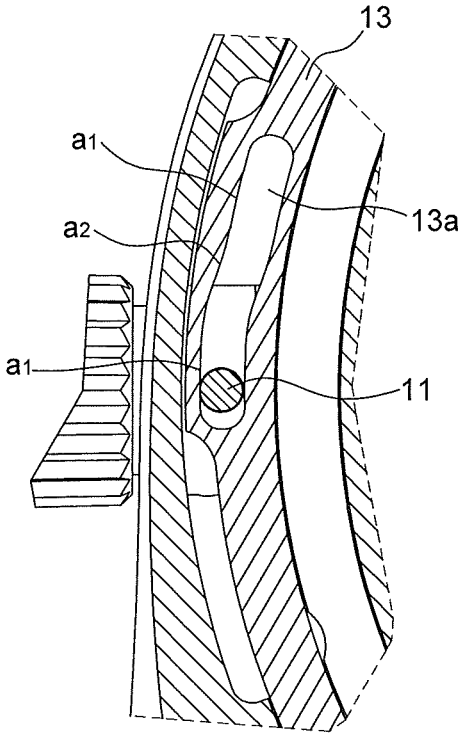

The device for locking the valve operates as follows. In FIG. 1A to 1D, the valve 3 is locked in the closed position, which corresponds, in the example shown, to the positioning of the grasping zone 13*b* of the movable part 13 in the 9 o'clock position. In this position, the finger 11 is engaged with the segment a1 of the recess 13*a* which is located the closest to the axis 1*a* of the case. It follows that the blocking element 9 is in the axial position thereof located the closest to the axis of the case. In this position, the shoulder 6*a* of the ring 6 is abutted against the inward part 10*a* of the sleeve 10. Any axial displacement of the valve towards the open position thereof located further away from the axis of the case is thus prevented. In FIG. 2A to 2C, the grasping zone 13*b* is made to rotate about a given angle by the user. In the example shown, the amplitude between the two positions is about 30°. Of course, this amplitude can be increased or decreased. After this angular displacement of the grasping zone 13*b* and thus of the movable part 13, the finger 11 of the blocking element 9 is positioned in the segment a1 of the recess 13*a* which is located further away from the axis of the case relative to the previous position. The blocking element 9 then undergoes an axial displacement in a direction opposite to the axis of the case freeing up a space D between the inward part 10*a* of the sleeve 10 and the shoulder 6*a* of the ring 6 (FIG. 2B). The user can then freely unscrew the valve in order to axially displace same over a maximum travel D where the valve is in the open position as shown in FIG. 3A-3C.

The locking device and the functioning thereof have been described for a valve, however it can also be used for a winding button which would be held in the sunken position by the same locking device. In a known manner, the winding button can adopt this sunken position, an intermediate position and a protruding position, respectively allowing the timepiece to be wound, a date to be changed and a time to be changed.

Finally, it should be specified that, alternatively to the alternative embodiments presented in FIG. 1A to 3C, the cam could be formed by a side surface delimiting a protruding portion made on the movable part and the follower could be formed by a recess made in the blocking element.

NOMENCLATURE (1) Case
a. Central axis
(2) Middle part
(3) Member, in particular valve or control member
(4) Head of the valve
(5) Hollow body of the valve (6) Ring of the valve
a. Shoulder
(7) Tube
(8) Rod
(9) Blocking element
(10) Sleeve of the blocking element
a. Inward part or bearing surface
b. Recess or housing or opening
(11) Finger
(12) Bezel
(13) Movable part
a. Inner recess
a1. Segment
a2. Transition zone
b. Protruding portion or grasping zone
(14) Gasket

The invention claimed is:

1. A timepiece comprising:

a case with a central axis substantially perpendicular to a general plane of the case, a control member or a valve mounted on the case such that the control member or valve can move in translation on a middle part of the case along a radial axis between at least a first position and a second position which is located further away from the central axis of the case than the first position, the control member or valve being screwed on at least one end part of the path between the second position and the first position, a locking device capable of blocking translation of the control member or valve in the first position, the locking device comprising:

a blocking element capable of undergoing translational displacement along the radial axis between a locking position and an unlocking position, where the control member or valve is respectively blocked or free to move in translation, a part mounted such that it can move in rotation about the central axis of the case and intended to be set in rotation by a user, drive means linking the angular displacement of the part mounted such that it can move in rotation to the translational displacement along the radial axis of the blocking element between the locking and unlocking positions.

2. The timepiece according to claim 1, wherein the drive means include a cam and a follower engaging with said cam, the cam and the follower being respectively made on the part mounted such that it can move in rotation and on the blocking element.

3. The timepiece according to claim 2, wherein the cam is formed by a recess made within the part mounted such that it can move in rotation, said recess being delimited by at least one side surface for guiding the follower, and wherein the follower is a finger disposed on the blocking element.

4. The timepiece according to claim 2, wherein the cam is formed by a protruding portion made on the part mounted such that it can move in rotation, said protruding portion being delimited by at least one side surface for guiding the follower, and wherein the follower is a recess hollowed out in the blocking element.

5. The timepiece according to claim 3, wherein the control member or valve includes a head overlooking a hollow body ending in a ring, said ring having an outer diameter that is greater than that of the hollow body so as to form a shoulder.

6. The timepiece according to claim 5, wherein the blocking element includes a cylindrical sleeve surrounding the ring and at least partially surrounding the hollow body.

7. The timepiece according to claim 6, wherein said sleeve includes, on an inner face thereof, an inward part defining a banking for the shoulder of the ring when the blocking element is in the locking position.

8. The timepiece according to claim 7, wherein the inward part is disposed at the end of the sleeve, which is positioned facing the head of the control member or valve.

9. The timepiece according to claim 7, wherein the finger includes a base and wherein the sleeve includes an opening in which the base of the finger is housed.

10. The timepiece according to claim 7, wherein said at least one guiding side surface gradually moves away from the central axis of the case.

11. The timepiece according to claim 10, wherein said at least one guiding side surface forms an arc of a circle.

12. The timepiece according to claim 10, wherein said at least one guiding side surface is formed by two segments respectively corresponding to the locking and unlocking positions separated by a transition zone allowing the follower to pass smoothly between the locking and unlocking positions.

13. The timepiece according to claim 12, wherein the segments are rectilinear and wherein the transition zone is curved, rectilinear or partially curved and rectilinear.

14. The timepiece according to claim 1, wherein said case comprises or supports a bezel, and wherein the part mounted such that it can move in rotation is a ring concealed beneath the bezel with a grasping zone extending outside of the perimeter delimited by an edge of the case so as to be accessible to the user.

15. The timepiece according to claim 1, wherein said case comprises or supports a bezel, and wherein the part mounted such that it can move in rotation is a ring that is partially concealed beneath the bezel, a visible portion of the ring extending over the circumference of the bezel so as to be accessible to the user.

16. The timepiece according to claim 1, wherein said case comprises or supports a bezel, and wherein the part mounted such that it can move in rotation is formed by said bezel.

17. The timepiece according to claim 1, wherein the blocking element is completely concealed beneath the movable part in the locking and unlocking positions.

18. The timepiece according to claim 1, wherein the control member is a winding button capable of adopting said first position, said second position and a third position, said first, second and third positions respectively enabling the timepiece to be wound, a date to be changed and a visible displayed time to be corrected.

19. The timepiece according to claim 1, wherein the valve is configured to adopt said first position corresponding to the closed position of the valve and said second position corresponding to the open position of the valve.

* * * * *